United States Patent [19]

Delepine

[11] 4,334,328

[45] Jun. 15, 1982

[54] WIDE-MOUTHED SPOUT FOR FLOW OF LIQUID

[76] Inventor: Jean C. Delepine, 23 rue Clapeyron, 75008 Paris, France

[21] Appl. No.: 207,609

[22] Filed: Nov. 17, 1980

[30] Foreign Application Priority Data

Nov. 16, 1979 [FR] France ..... 79 28285

[51] Int. Cl.[3] ..... E03C 1/00

[52] U.S. Cl. ..... 4/191; 4/192

[58] Field of Search ..... 4/191, 192, 591, 195

[56] References Cited

U.S. PATENT DOCUMENTS

| | | | |
|---|---|---|---|
| 1,383,886 | 7/1921 | Webb, Sr. | 4/192 |
| 1,406,030 | 2/1922 | Kelly | 4/192 |
| 1,408,375 | 2/1922 | Manelis | 4/192 |
| 1,417,583 | 5/1922 | Stratton | 4/192 |
| 1,512,193 | 10/1924 | Berven | 4/591 |
| 2,679,652 | 6/1954 | Eyring | 4/591 X |
| 2,993,213 | 7/1961 | Carroll | 4/591 |
| 4,231,123 | 11/1980 | Cheng | 4/591 X |

FOREIGN PATENT DOCUMENTS

| | | | |
|---|---|---|---|
| 2219893 | 12/1972 | Fed. Rep. of Germany | 4/192 |
| 740490 | 1/1933 | France | 4/192 |
| 201451 | 8/1923 | United Kingdom | 4/591 |
| 576928 | 4/1946 | United Kingdom | 4/192 |

*Primary Examiner*—Henry K. Artis

*Attorney, Agent, or Firm*—Fisher, Christen & Sabol

[57] ABSTRACT

The present invention relates to a wide-mouthed flow spout connected to at least one liquid delivery pipe, comprising a wide flat chamber in the form of a blade, into which said liquid delivery pipe opens and which is in communication with the outside via a long narrow slot. The invention is more particularly applicable to the production of such spouts for filling bathtubs.

9 Claims, 3 Drawing Figures

WIDE-MOUTHED SPOUT FOR FLOW OF LIQUID

The present invention relates to a wide-mouthed flow spout connected to at least one liquid delivery pipe which is particularly, but not exclusively, adapted to be used for filling a bathtub.

Heretofore known faucets for filling bathtubs are known to deliver a jet of water of substantially circular section. This results in the bathtub being filled noisily.

It is an object of the present invention to remedy this drawback.

To this end, according to the invention, the flow spout connected to at least one liquid delivery pipe is noteworthy in that it comprises a wide flat chamber in blade form, into which said liquid delivery pipe opens and which is in communication with the outside via a long, narrow slot.

Thus, the jet emitted by the spout according to the invention is in the form of a curtain, this making it less noisy to fill a bathtub. Furthermore, the spout according to the invention does not require an anti-splash nozzle and it is consequently less susceptible to furring than heretofore known spouts.

The adjustment in length of the curtain emitted depends on the rate of flow. Moreover, for a low rate of flow, the curtain is not continuous but is, on the contrary, constituted by separate thin streams.

For the spout according to the invention to function well, the liquid delivery pipe is advantageously substantially at right angles to said flat chamber. This liquid delivery pipe preferably opens into said chamber on the side opposite the slot.

To avoid zones of cavitation, deflectors are provided inside said chamber, disposed on either side of the liquid delivery pipe and widening out from said delivery pipe to said slot.

The slot may be defined between two parallel plates, rendered hermetically fast with each other over the whole of their periphery, except where the slot is located. When these plates are substantially horizontal, the upper plate may serve as a shelf-like support. The edge of the plates adjacent the slot is advantageously curved downwardly, in order to direct the curtain of water towards a bathtub to be filled.

A casing surrounding the or each fluid delivery pipe and serving as a base for the spout may be provided beneath the lower plate.

The invention will be more readily understood on reading the following description with reference to the accompanying drawings, in which.

Figure 1:
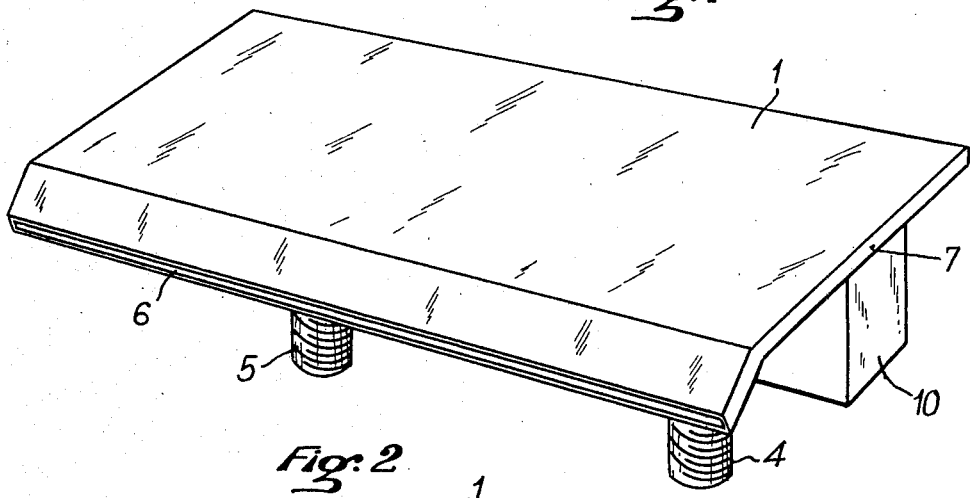
FIG. 1 is a perspective view of a water flow spout according to the present invention.
Figure 2:
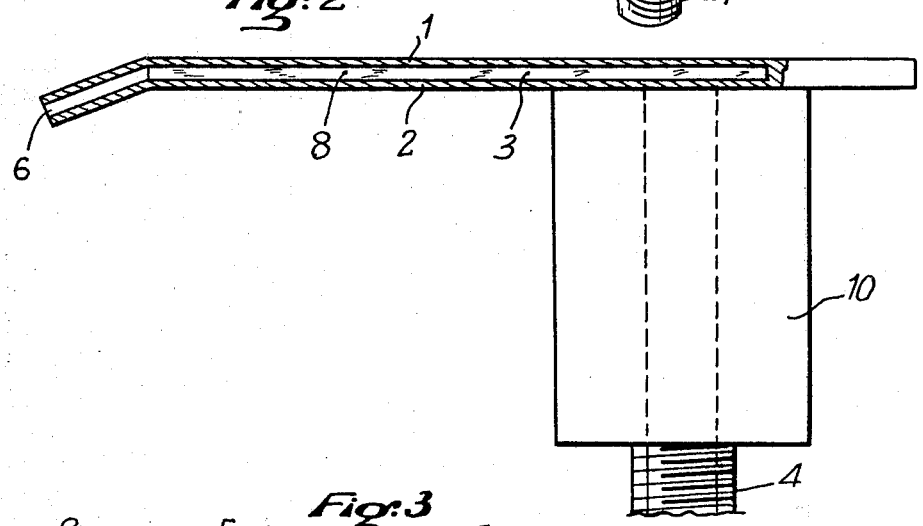
FIG. 2 is a part transverse section through FIG. 1.
Figure 3:
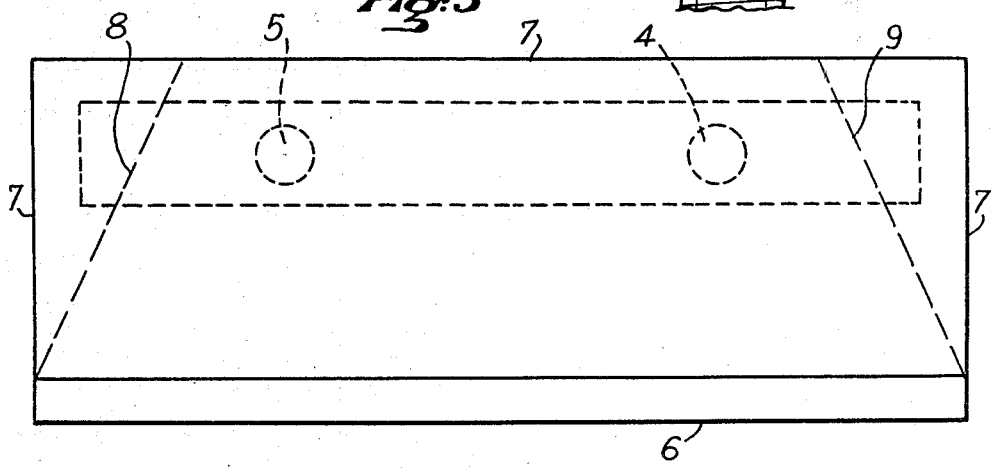
FIG. 3 is a plan view of the spout of FIG. 1.

Referring now to the drawings, the water flow spout according to the invention comprises two parallel, horizontal, substantially rectangular plates 1 and 2, defining therebetween a horizontal space 3 of relatively large surface, but of small height. Hot-and cold-water delivery pipes 4 and 5 open into the space 3. The pipes 4 and 5 are at least substantially at right angles to the space 3 and are located near a large side of the plates 1 and 2.

The large sides of the plates 1 and 2, opposite the pipes 4 and 5, are curved downwardly, parallel to each other, so that the space 3 forms a downwardly inclined horizontal flow slot 6. The small sides of the space 3 and the large side adjacent the pipes 4 and 5 are hermetically closed by peripheral edges 7.

Moreover, deflectors 8 and 9, surrounding the pipes 4 and 5 and widening out therefrom towards the slot 6, are provided in the space 3. The pipes 4 and 5 are enclosed in a casing 10 serving as base for the plates 1 and 2, so that the plate 1 can serve as shelf.

What is claimed is:

1. A wide-mouthed flow spout connected to at least one liquid delivery pipe for emitting a curtain of liquid from the spout comprising a wide flat chamber in the form of a blade into which said at least one liquid delivery pipe opens, said chamber being in communication with the outside via a long narrow slot in a side of the chamber, the length of the slot being substantially equal to the length of the cross-section of the chamber transversely to the flow of liquid from said chamber.

2. The flow spout of claim 1, wherein said at least one liquid delivery pipe is substantially at right angles to said chamber.

3. The flow spout of claim 1 or 2, wherein said at least one liquid delivery pipe opens into said chamber on the side opposite the slot.

4. The flow spout of claim 1, wherein deflectors are provided inside said chamber, these deflectors being disposed on either side of said at least one liquid delivery pipe and widening out therefrom up to the slot.

5. The flow spout of claim 1, wherein said chamber is defined between two parallel plates, made hermetically fast with each other over the whole of their periphery, except where said slot is located.

6. The flow spout of claim 5, wherein said plates are substantially horizontal so that the upper plate forms a shelf-like support.

7. The flow spout of claim 6, wherein the edges of the plates adjacent the slot are curved downwardly.

8. The flow spout of claim 5, wherein a casing is provided beneath the lower plate, which encloses said at least one liquid delivery pipe and serves as a base for said spout.

9. The flow spout of claim 1 wherein two liquid delivery pipes open into said chamber.

* * * * *